US006527403B2

(12) United States Patent
Manuel

(10) Patent No.: US 6,527,403 B2
(45) Date of Patent: Mar. 4, 2003

(54) SEWING MACHINE WITH A LIGHT BARRIER

(75) Inventor: Karl-Ludwig Manuel, Otterbach (DE)

(73) Assignee: Pfaff Industrie Maschinen AG (DE)

( * ) Notice: Subject to any disclaimer, the term of this patent is extended or adjusted under 35 U.S.C. 154(b) by 0 days.

(21) Appl. No.: 09/837,647

(22) Filed: Apr. 18, 2001

(65) Prior Publication Data

US 2001/0033496 A1 Oct. 25, 2001

(30) Foreign Application Priority Data

Apr. 20, 2000 (DE) ..... 200 07 366

(51) Int. Cl.[7] ..... D05B 79/00

(52) U.S. Cl. ..... 362/90; 362/276; 362/581; 112/272

(58) Field of Search ..... 362/276, 90, 551, 362/802, 581; 112/271, 272

(56) References Cited

U.S. PATENT DOCUMENTS

| | | | | |
|---|---|---|---|---|
| 4,226,198 A | | 10/1980 | Petry | 112/121.12 |
| 4,696,246 A | | 9/1987 | Rohr et al. | 112/272 |
| 4,858,541 A | * | 8/1989 | Ozawa | 112/272 |
| 4,924,790 A | * | 5/1990 | Kondo et al. | 112/272 |
| 5,113,324 A | * | 5/1992 | Dusch | 362/33 |
| 5,215,020 A | * | 6/1993 | Pordzik | 112/272 |
| 5,868,090 A | | 2/1999 | Hartsell, Jr. | 112/272 |

FOREIGN PATENT DOCUMENTS

| | | |
|---|---|---|
| DE | 35 19 729 | 12/1986 |
| JP | 3-191986 | 8/1991 |

* cited by examiner

*Primary Examiner*—Stephen Husar
*Assistant Examiner*—John Anthony Ward
(74) *Attorney, Agent, or Firm*—McGlew and Tuttle, P.C.

(57) ABSTRACT

A sewing machine with a light barrier used to detect the edge of a workpiece has an optical light guide (17) connected to the light source (15). The optical guide (17) is arranged in the thread guide hook (12). The thread guide hook (12) is fastened to the front side of the head (4) of the housing and is designed as a small tube for this purpose.

10 Claims, 1 Drawing Sheet

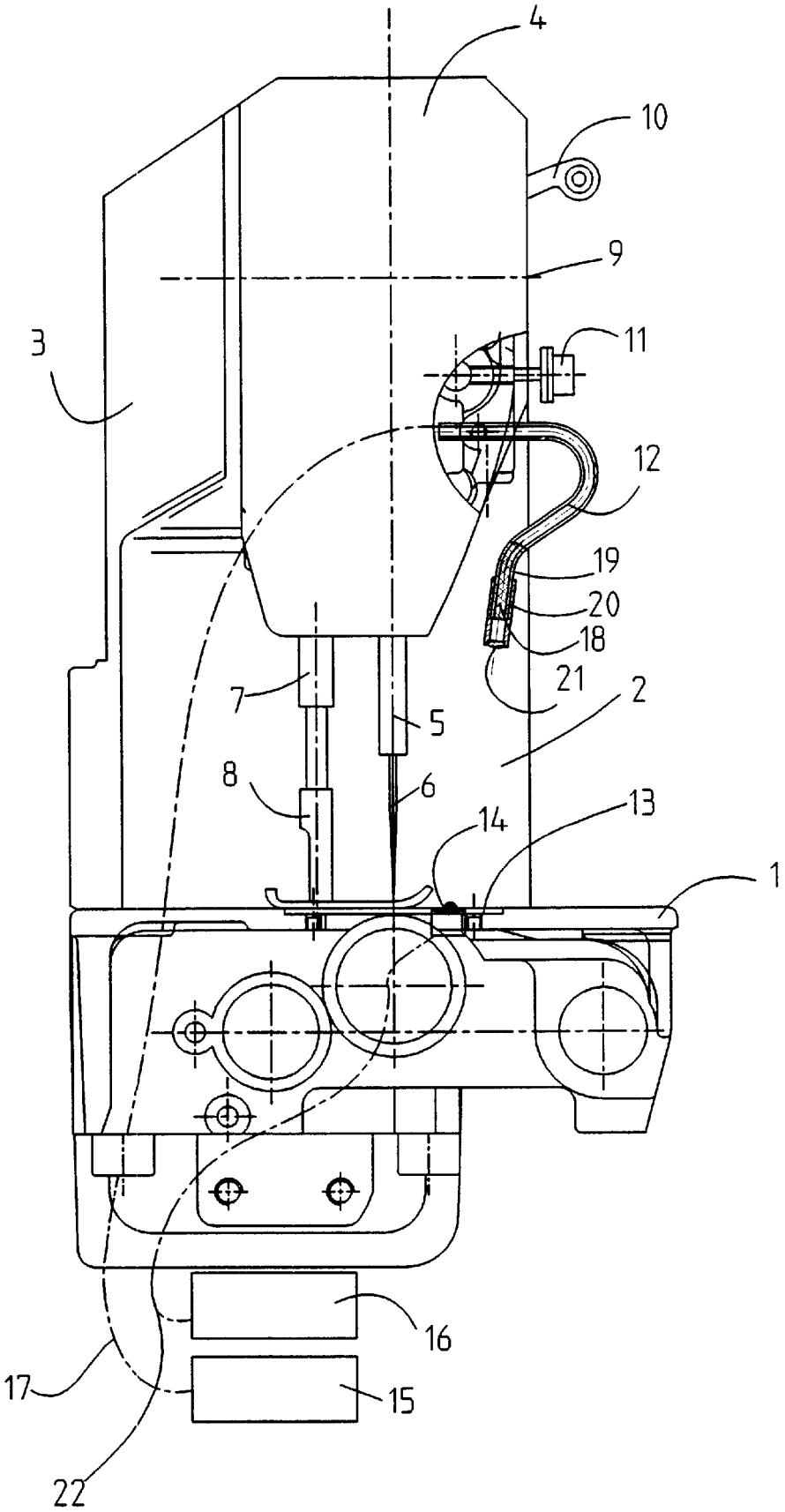
4
10
9
3
11
12
19
20
18
21
2
7
5
8
6
14
13
1
16
17
15
22

SEWING MACHINE WITH A LIGHT BARRIER

FIELD OF THE INVENTION

The present invention pertains to a sewing machine with a light barrier and a light source and a light receiver for detecting the edge of a workpiece in the area of the stitch formation site with the light source is connected via an optical light guide to a lens.

BACKGROUND OF THE INVENTION

A sewing machine with an optoelectronic edge scanning device, in which the light source is connected to a lens via an optical light guide, has been known from DE 35 19 729 C2. An alternative embodiment, in which the light source and the lens are accommodated in a common housing without the interposition of an optical light guide as a light transmitter, is explained in greater detail and represented graphically in the exemplary embodiment of DE-C2. According to the drawing of DE-C2, this light transmitter is arranged in the middle lower area of the front side of the head of the housing. However, there is no free space in this area for the arrangement of the light transmitter at all, because the needle thread coming from the thread take-up lever runs along there.

Other devices and thread guides are known, e.g., with one or more thread-tensioning devices, in which the thread-pulling spring, the thread guide hook and a plurality of thread guide eyelets are arranged on the front side of the head of the housing, besides the thread take-up lever. The space between these devices and guides must remain free for the unhindered movement of the needle thread. The light transmitter is arranged, as is generally usual, either at the edge of the head of the housing or on a laterally extending cantilever bracket, which is in turn fastened to the edge of the head of the housing. If a cantilever bracket is used, the view to the thread-tensioning device may be obstructed and the handling of the thread take-up lever may be compromised during threading.

SUMMARY AND OBJECTS OF THE INVENTION

The basic object of the present invention is to arrange the end section of an optical light guide connected to a light source such that the view to the devices located on the front side of the head of the housing is not obstructed, nor is the handling of the thread take-up lever compromised during threading.

According to the invention, a sewing machine with a light barrier is provided comprising a light source and a light receiver for detecting the edge of a workpiece in the area of the stitch formation site. The light source is connected via an optical light guide to a lens. The lens is arranged in the head area of the sewing machine. A thread guide hook is located in the vicinity of the thread-tensioning device and is designed as a small tube. The optical light guide is led through the thread guide hook. The lens is arranged on the obliquely downwardly directed free end of the thread guide hook.

The lens may be accommodated in a threaded sleeve arranged adjustably on the thread guide hook.

Due to the thread guide hook being designed as a small tube and to the optical light guide being arranged within this small tube, a component of the sewing machine which is present anyway is used with the thread guide hook as a bracket for the end section of the optical light guide and the lens, so that there are no problems here whatsoever concerning the free view to the devices and thread guides located on the front side of the head and there are no difficulties concerning the free access to these components.

The present invention will be explained on the basis of an exemplary embodiment shown in the drawing.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

In the drawing:

The only FIGURE schematically shows a side view of a sewing machine according to the invention.

DESCRIPTION OF THE PREFERRED EMBODIMENT

Referring to the drawing in particular, The machine housing has a baseplate 1, a column 2, and an arm 3, which passes over into a head 4.

A needle bar 5 with a needle 6, a pressure bar 7 with a presser foot 8 as well as a thread take-up lever 10 partially projecting beyond the front side 9 of the head 4 are mounted in the head 4 in the known manner. Only the thread-tensioning device 11 and the thread guide hook 12 are shown in the drawing of the devices and thread guides usually located on the front side of the head 4. The work area of the needle 6 in the plane of the needle plate 13 forms the stitch formation site of the sewing machine.

The thread guide hook 12 is not massive, as is otherwise usual, but is designed as a small tube and is consequently hollow. The free end of the thread guide hook 12 is directed obliquely downward in the direction of a lens 14 recessed in the needle plate 13.

The light barrier contains a light source 15 and a sensor 16 acting as a light receiver. These components are arranged within the baseplate 1. They are shown under the baseplate 1 in the drawing only for the sake of greater clarity.

An optical light guide 17, represented by a dash-dotted line, which, beginning from the baseplate 1, is introduced into the hollow thread guide hook 12 through the column 2, the arm 3 and the head 4, is connected to the light source 15. The end section 18 of the optical light guide 17 is terminated with the free end of the thread guide hook 12.

A threaded sleeve 20 provided with opposing threads is screwed onto a threaded section 19 provided at the free end of the thread guide hook 12. The threaded sleeve 20 carries a lens 21, by means of which the light beam emitted by the light source 15 and passed through the optical light guide 17 is focused on the lens 14 recessed into the needle plate 13. The focusing can be fine-tuned by rotating the threaded sleeve 20.

The light beam received by the lens 14 is again focused for the entry into a second optical light guide 22, which is likewise represented as a dash-dotted line, and is then sent to the sensor 16, where it is then converted into an electric signal and is finally subjected to further signal processing in the known manner.

While specific embodiments of the invention have been shown and described in detail to illustrate the application of the principles of the invention, it will be understood that the invention may be embodied otherwise without departing from such principles.

What is claimed is:

1. A sewing machine with a light barrier, the sewing machine comprising:

a light source;

an optical light guide;

a lens arranged in a head area of the sewing machine;

a light receiver for detecting the edge of a workpiece in the area of a stitch formation site, said light source being connected via said optical light guide to said lens; and a thread guide hook located in a vicinity of a thread-tensioning device, said thread guide hook comprising a small tube, said optical light guide being led through said thread guide hook, said lens being arranged on an obliquely downwardly directed free end of said thread guide hook.

2. A sewing machine in accordance with claim 1, wherein said lens is accommodated in a threaded sleeve arranged adjustably on said thread guide hook.

3. A sewing machine with a light barrier, the sewing machine comprising:

a baseplate;

a column connected to said baseplate;

an arm connected to said column;

a head connected to said column;

a thread-tensioning device connected to said head;

a light source;

an optical light guide;

a lens arranged in a head area of the sewing machine;

a light receiver for detecting the edge of a workpiece in the area of a stitch formation site, said light source being connected via said optical light guide to said lens; and a thread guide hook located adjacent to said thread-tensioning device, said thread guide hook comprising a small tube, said optical light guide being led through said thread guide hook.

4. A sewing machine in accordance with claim 3, wherein said lens is accommodated in a threaded sleeve arranged adjustably on said thread guide hook.

5. A sewing machine comprising:

a stitch formation site;

a sewing head forming stitches with said stitch formation site;

a thread guide arranged in said head;

an optical light guide extending through said thread guide;

a light source connected to one end of said light guide;

a lens connected to another end of said light guide;

a light receiver arranged at said stitch formation site and detectable of an edge of a workpiece in said stitch formation site.

6. A sewing machine in accordance with claim 5, wherein:

said thread guide includes a tube;

said light guide is arranged in said tube.

7. A sewing machine in accordance with claim 5, further comprising:

a thread-tensioning device arranged adjacent said thread guide.

8. A sewing machine in accordance with claim 5, wherein:

said light receiver receives light from said lens to detect the edge of the workpiece.

9. A sewing machine in accordance with claim 6, wherein:

said light receiver receives light from said lens to detect the edge of the workpiece.

10. A sewing machine in accordance with claim 5, wherein:

said lens is accommodated in a threaded sleeve arranged adjustably on said thread guide.

* * * * *